United States Patent [19]

Watanabe

[11] 3,941,590

[45] Mar. 2, 1976

[54] PRECIPITATION HARDENING NI BASE ALLOY

[75] Inventor: Rikizo Watanabe, Yasugi, Japan

[73] Assignee: Hitachi Metals, Ltd., Japan

[22] Filed: Aug. 5, 1974

[21] Appl. No.: 494,904

[30] Foreign Application Priority Data

Aug. 8, 1973 Japan ..... 48-88389

[52] U.S. Cl. ..... 75/171; 148/32.5

[51] Int. Cl.[2] ..... C22C 19/05

[58] Field of Search ..... 75/171, 170; 148/32, 32.5

[56] References Cited

UNITED STATES PATENTS 3,385,698 5/1968 MacFarlane et al. ..... 75/171

3,615,376 10/1971 Ross ..... 75/171

*Primary Examiner*—R. Dean

*Attorney, Agent, or Firm*—Craig & Antonelli

[57] ABSTRACT

Precipitation hardening Ni base alloys comprising not more than 0.2% by weight of C, 17 to 19% by weight of Cr, 3.5 to 4.5% by weight of Mo, 5 to 7% by weight of W, 5 to 15% by weight of Co, 1.75 to 2.25% by weight of Al, 2.0 to 3.5% by weight of Ti, not more than 0.02% by weight of B, not more than 0.3% by weight of Zr and the balance of Ni and incidental impurities have good hot workability and high stress rupture strength at high temperatures of about 1,000°C.

11 Claims, No Drawings

PRECIPITATION HARDENING NI BASE ALLOY

The present invention relates to a precipitation hardening alloy having a good hot workability and high stress rupture strength at high temperature of about 1,000°C.

Materials for heat exchangers of high temperature gas reactors for atomic energy steel making processes require high strength at high temperatures and good hot workability. In the case of conventional precipitation hardened Ni base alloys, those which have high strength at high temperatures of about 1,000°C have poor hot workability and those which have high hot workability have insufficient strength at high temperatures.

The object of the present invention is to provide a precipitation hardening Ni base alloy which has both high strength at high temperatures of about 1,000°C and good hot workability and which can be used as a material for heat exchangers of high temperature gas reactors for atomic energy steel making processes.

The precipitation hardening Ni base alloy of the present invention comprises not more than 0.2% by weight of C, 17 to 19% by weight of Cr, 3.5 to 4.5% by weight of Mo, 5 to 7% by weight of W, 5 to 15% by weight of Co, 1.75 to 2.25% by weight of Al, 2.0 to 3.5% by weight of Ti, not more than 0.02% by weight of B, not more than 0.3% by weight of Zr and the balance being substantially Ni except the incidental impurities.

C in the present alloy combines with Ti to form an MC type carbide and prevents coarse austenite grains and strengthens grain boundaries so that a small amount of C is necessary. When the amount of C exceeds 0.2% by weight, excess carbide is formed to damage the hot workability of the alloy. Thus, the amount of C is limited to 0.2% by weight or less. More preferably, the amount of C is not more than 0.1% by weight.

Cr is essential for imparting oxidation resistance to the alloy and at least 17% by weight of Cr is necessary for imparting good oxidation resistance while when it exceeds 19% by weight, the structure of the alloy becomes unstable and formation of undesired intermetallic compounds such as $\sigma$ phase is accelerated. Thus, the content of Cr is limited to 17 to 19% by weight. A more preferred range for the Cr content is 17.5 to 19% by weight.

Mo is mainly dissolved in matrix of alloy to solid-solution-strengthen the alloy and thus at least 3.5% by weight of Mo is necessary. However, when it exceeds 4.5% by weight, structure is unstabilized. Therefore, content of Mo in the present alloy is limited to 3.5 to 4.5% by weight.

W is dissolved in matrix of alloy to solid solution-strengthen the alloy and simultaneously is also dissolved in the gamma prime phase as a solid solution to strengthen it. Therefore, at least 5% by weight of W is necessary, but more then 7% by weight of W causes instability of structure and is not prefrred. Thus, the content of W in the present alloy is limited to 5 to 7% by weight. A more preferred range for the W content is 5.5 to 6.5% by weight.

Co is dissolved in the matrix of the alloy to strengthen the alloy. Therefore, at least 5% by weight of Co is necessary, but more than 15% by weight of Co destabilizes the structure. Thus, the content of Co in the present alloy is limited to 5 to 15% by weight. A more preferred range for the Co content is 8 to 12% by weight.

Al is an element essential for forming the gamma primery phase and precipitation hardening the alloy. At least 1.75% by weight of Al is required for imparting sufficient precipitation hardenability to the alloy, but more than 2.25% by weight of Al destabilizes the structure of the alloy and decreases the hot workability of the alloy. Therefore, the content of Al in the present alloy is limited to 1.75 to 2.25% by weight. A more preferred range for the Al content is 1.8 to 2.2% by weight.

Ti is dissolved in the gamma prime phase as a solid solution to increase the lattice constant and to impart lattice conformity between the gamma prime phase and the matrix. In these respects, Ti is an essential element. At least 2.0% by weight of Ti is necessary, but more than 3.5% by weight of Ti excessively increases the gamma prime phase to cause a decrease in the hot workability of the alloy and furthermore excessively increases the lattice constant of the gamma prime phase to cause a reduction in lattice conformity between the gamma prime phase and the matrix. Thus, the content of Ti in the present alloy is limited to 2.0 to 3.5% by weight. A more preferred range for the Ti content is 2 to 3% by weight.

B is necessary in a small amount because it strengthens grain boundary and improves strength at high temperature. However, more than 0.02% by weight of B causes a decrease in melting temperature of the grain boundary and a reduction in hot workability. Therefore, the content of B in the present alloy is limited to not more than 0.02% by weight. A more preferred range for the B content is not more than 0.01% by weight.

Zr is necessary in a small amount because like B, it strengthens grain boundary and improves strength at high temperature. However, more than 0.3% by weight of Zr causes a decrease in melting temperature of the grain boundary and a reduction in hot workability. Thus, the content of Zr in the present alloy is limited to not more than 0.3% by weight. A more preferred range for the Zr content is not more than 0.15% by weight.

Table 1 shows the chemical compositions of samples used for a comparison of the strength at high temperature of the alloys of the present invention with that of a conventional alloy. The conventional alloy shown in Table 1 is the strongest alloy among the conventional precipitation hardening Ni base alloys having a sufficiently excellent hot workability as a material for heat exchanger. The alloys of the present invention exhibit good forgeability which is similar to or higher than that of the conventional alloy in Table 1 in an actual forging operation.

Table 1

| | (% by weight) | | | | | | | | | |
|---|---|---|---|---|---|---|---|---|---|---|
| | C | Cr | Mo | W | Co | Al | Ti | B | Zr | Ni |
| Alloy of the present invention (1) | 0.04 | 18.0 | 4.1 | 5.8 | 10.1 | 2.0 | 2.3 | 0.003 | 0.05 | Balance |

Table 1-continued

| | C | Cr | Mo | W | Co | Al | Ti | B | Zr | Ni |
|---|---|---|---|---|---|---|---|---|---|---|
| | | | | (% by weight) | | | | | | |
| " (2) | 0.05 | 18.9 | 4.0 | 5.8 | 10.7 | 2.1 | 2.4 | 0.004 | 0.05 | " |
| Conventional alloy | 0.12 | 15.1 | 3.6 | — | 25.2 | 2.9 | 2.1 | 0.002 | 0.11 | " |

The alloys of the present invention in Table 1 were subjected to three heat treatments as shown in Table 2. The conventional alloy was subjected to the standard heat treatment, namely, 1,205°C × 2 hrAC + 870°C × 24 hrAC. ("AC" means air cooling.) Thereafter, these alloys were subjected to the tests as shown in Table 3.

Table 2

| | |
|---|---|
| A | 1,200°C × 2hrAC + 1,020°C × 4hrAC |
| B | 1,200°C × 2hrAC + 1,050°C × 4hrAC |
| C | 1,200°C × 2hrAC + 1,080°C × 4hrAC |

Results of a stress rupture test under a stress of 5 kg/mm² at 1,000°C are shown in Table 3. From table 3, it is recognized that the alloys of the present invention have much higher strengths at high temperature compared with the conventional alloy.

TABLE 3

| Alloy | | Form | Heat treatment | Rupture time (Hr) | Elongation (%) | Contraction (%) |
|---|---|---|---|---|---|---|
| Alloy of the present invention | (1) | 75 mm square | A | 208 | 46 | 44 |
| " | (1) | " | B | 258 | 30 | 37 |
| " | (1) | " | C | 221 | 42 | 41 |
| " | (2) | 60 mm square | B | 360 | 41 | 39 |
| " | (2) | 22 mm in diameter | B | 342 | 50 | 44 |
| The conventional alloy | | 25 mm square | | 38 | 64 | 83 |

What is claimed is:

1. A precipitation hardening Ni base alloy consisting essentially of not more than 0.2% by weight of C, 17 to 19% by weight of Cr, 3.5 to 4.5% by weight of Mo, 5 to 7% by weight of W, 5 to 15% by weight of Co, 1.75 to 2.25% by weight of Al, 2.0 to 3.5% by weight of Ti, not more than 0.02% by weight of B, not more than 0.3% by weight of Zr and the balance of Ni except incidental impurities.

2. A precipitation hardening Ni base alloy consisting essentially of not more than 0.1% by weight of C, 17.5 to 19% by weight of Cr, 3.5 to 4.5% by weight of Mo, 5.5 to 6.5% by weight of W, 8 to 12% by weight of Co, 1.8 to 2.2% by weight of Al, 2.0 to 3.0% by weight of Ti, not more than 0.01% by weight of B, not more than 0.15% by weight of Zr and the balance of Ni except incidental impurities.

3. A precipitation hardening Ni base alloy consisting essentially of about 0.05% by weight of C, about 18% by weight of Cr, about 4% by weight of Mo, about 6% by weight of W, about 10% by weight of Co, about 2% by weight of Al, about 2.5% by weight of Ti, about 0.003% by weight of B, about 0.07% by weight of Zr and the balance of Ni except incidental impurities.

4. The alloy of claim 1, wherein the carbon content is not more than 0.1% by weight.

5. The alloy of claim 1, wherein the chromium content is 17.5 to 19% by weight.

6. The alloy of claim 1, wherein the tungsten content is 5.5 to 6.5% by weight.

7. The alloy of claim 1, wherein the cobalt content is 8 to 12% by weight.

8. The alloy of claim 1, wherein the aluminum content is 1.8 to 2.2% by weight.

9. The alloy of claim 1, wherein the titanium content is 2.0 to 3.0% by weight.

10. The alloy of claim 1, wherein the boron content is not more than 0.1% by weight.

11. The alloy of claim 1, wherein the zirconium content is not more than 0.15% by weight.

* * * * *